US006247862B1

(12) United States Patent
Garza

(10) Patent No.: US 6,247,862 B1
(45) Date of Patent: Jun. 19, 2001

(54) HAND-HELD LIQUID/LOTION DISPENSING DEVICE

(76) Inventor: Matilde Garza, 60731 Latham Trail, Joshua Tree, CA (US) 92252

( * ) Notice: Subject to any disclaimer, the term of this patent is extended or adjusted under 35 U.S.C. 154(b) by 0 days.

(21) Appl. No.: 09/663,508

(22) Filed: Sep. 15, 2000

(51) Int. Cl.[7] ..... A46B 5/02

(52) U.S. Cl. ..... 401/6; 401/187; 401/205; 401/188 R

(58) Field of Search ..... 401/6, 187, 188 R, 401/205, 183, 184, 185

(56) References Cited

U.S. PATENT DOCUMENTS 2,800,673 * 7/1957 Lazisky ..... 401/6
2,995,768 * 8/1961 Skuratowicz ..... 401/6
4,826,340 * 5/1989 Rothweiler et al. ..... 401/6
5,931,591 * 8/1999 McCracken ..... 401/6
6,129,469 * 10/2000 Messer et al. ..... 401/6

* cited by examiner

*Primary Examiner*—David J. Walczak

(57) ABSTRACT

A hand-held liquid/lotion dispensing device for applying lotion, medicinal rubs, oils, sunscreens to the user's back. The hand-held liquid/lotion dispensing device includes an elongate member having a handle portion, an elongate intermediate portion connected to the handle portion, and a dispensing head portion connected to the intermediate portion and having a compartment disposed therein with the compartment being adapted to store liquid/lotion therein; and also includes a pump assembly for urging the liquid/lotion from the dispensing head portion; and further includes an applicator assembly being removably attached to the dispensing head portion.

14 Claims, 2 Drawing Sheets

HAND-HELD LIQUID/LOTION DISPENSING DEVICE

BACKGROUND OF THE INVENTION

1. Field of the Invention

The present invention relates to a universal liquid body dispenser and more particularly pertains to a new hand-held liquid/lotion dispensing device for applying lotion, medicinal rubs, oils, sunscreens to the user's back.

2. Description of the Prior Art

The use of a universal liquid body dispenser is known in the prior art. More specifically, a universal liquid body dispenser heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 4,861,180; U.S. Pat. No. 5,240,339; U.S. Pat. No. 5,931,590; U.S. Pat. No. 5,087,138; U.S. Pat. No. 4,299,005; and U.S. Pat. No. Des. 384,436.

While these devices fulfill their respective, particular objectives and requirements, the aforementioned patents do not disclose a new hand-held liquid/lotion dispensing device. The inventive device includes an elongate member having a handle portion, an elongate intermediate portion connected to the handle portion, and a dispensing head portion connected to the intermediate portion and having a compartment disposed therein with the compartment being adapted to store liquid/lotion therein; and also includes a pump assembly for urging the liquid/lotion from the dispensing head portion; and further includes an applicator assembly being removably attached to the dispensing head portion.

In these respects, the hand-held liquid/lotion dispensing device according to the present invention substantially departs from the conventional concepts and designs of the prior art, and in so doing provides an apparatus primarily developed for the purpose of applying lotion, medicinal rubs, oils, sunscreens to the user's back.

SUMMARY OF THE INVENTION

In view of the foregoing disadvantages inherent in the known types of universal liquid body dispenser now present in the prior art, the present invention provides a new hand-held liquid/lotion dispensing device construction wherein the same can be utilized for applying lotion, medicinal rubs, oils, sunscreens to the user's back.

The general purpose of the present invention, which will be described subsequently in greater detail, is to provide a new hand-held liquid/lotion dispensing device which has many of the advantages of the universal liquid body dispenser mentioned heretofore and many novel features that result in a new hand-held liquid/lotion dispensing device which is not anticipated, rendered obvious, suggested, or even implied by any of the prior art universal liquid body dispenser, either alone or in any combination thereof.

To attain this, the present invention generally comprises an elongate member having a handle portion, an elongate intermediate portion connected to the handle portion, and a dispensing head portion connected to the intermediate portion and having a compartment disposed therein with the compartment being adapted to store liquid/lotion therein; and also includes a pump assembly for urging the liquid/lotion from the dispensing head portion; and further includes an applicator assembly being removably attached to the dispensing head portion.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new hand-held liquid/lotion dispensing device which has many of the advantages of the universal liquid body dispenser mentioned heretofore and many novel features that result in a new hand-held liquid/lotion dispensing device which is not anticipated, rendered obvious, suggested, or even implied by any of the prior art universal liquid body dispenser, either alone or in any combination thereof.

It is another object of the present invention to provide a new hand-held liquid/lotion dispensing device which may be easily and efficiently manufactured and marketed.

It is a further object of the present invention to provide a new hand-held liquid/lotion dispensing device which is of a durable and reliable construction.

An even further object of the present invention is to provide a new hand-held liquid/lotion dispensing device which is susceptible of a low cost of manufacture with regard to both materials and labor, and which accordingly is then susceptible of low prices of sale to the consuming public, thereby making such 1 hand-held liquid/lotion dispensing device economically available to the buying public.

Still yet another object of the present invention is to provide a new hand-held liquid/lotion dispensing device which provides in the apparatuses and methods of the prior art some of the advantages thereof, while simultaneously overcoming some of the disadvantages normally associated therewith.

Still another object of the present invention is to provide a new hand-held liquid/lotion dispensing device for applying lotion, medicinal rubs, oils, sunscreens to the user's back.

Yet another object of the present invention is to provide a new hand-held liquid/lotion dispensing device which includes an elongate member having a handle portion, an elongate intermediate portion connected to the handle portion, and a dispensing head portion connected to the intermediate portion and having a compartment disposed therein with the compartment being adapted to store liquid/lotion therein; and also includes a pump assembly for urging the liquid/lotion from the dispensing head portion; and further includes an applicator assembly being removably attached to the dispensing head portion.

Still yet another object of the present invention is to provide a new hand-held liquid/lotion dispensing device that allows the user to conveniently and easily apply lotions and liquids to one's own back without assistance.

Even still another object of the present invention is to provide a new hand-held liquid/lotion dispensing device that reduces the mess associated with using one's hands to apply lotions and liquids to one's back.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
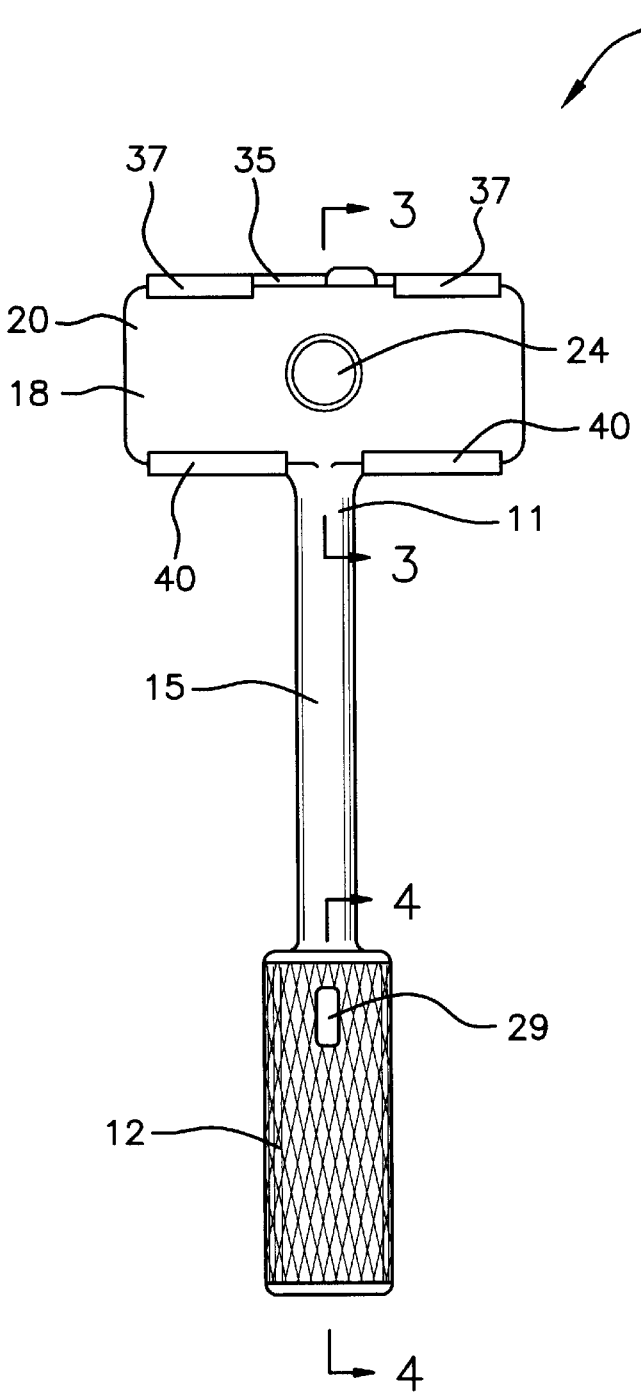
FIG. 1 is a back elevational view of a new hand-held liquid/lotion dispensing device according to the present invention.
Figure 2:
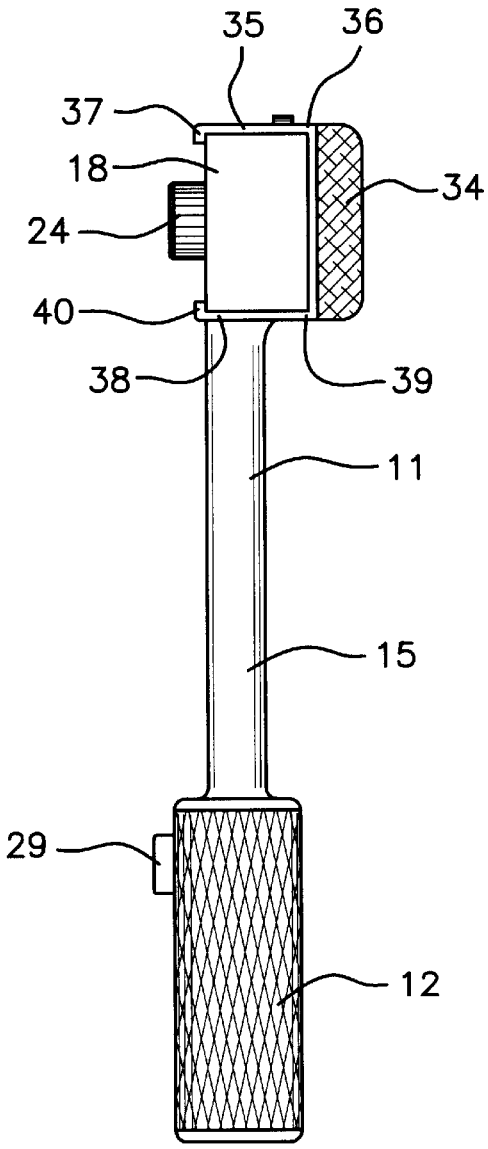
FIG. 2 is a side elevational view of the present invention.
Figure 3:
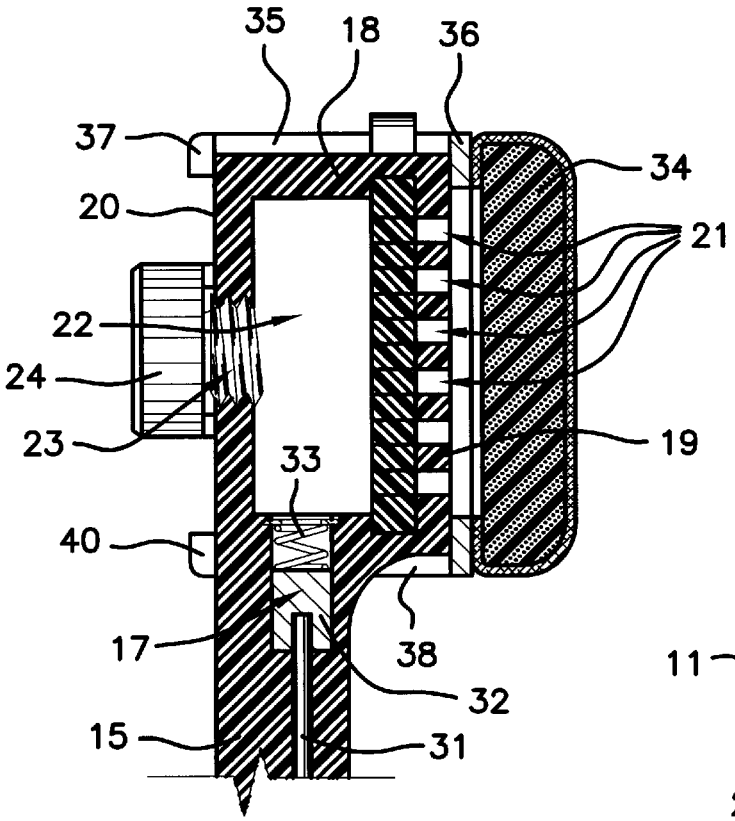
FIG. 3 is a cross-sectional view of the head portion and upper portion of the intermediate portion of the present invention.
Figure 4:
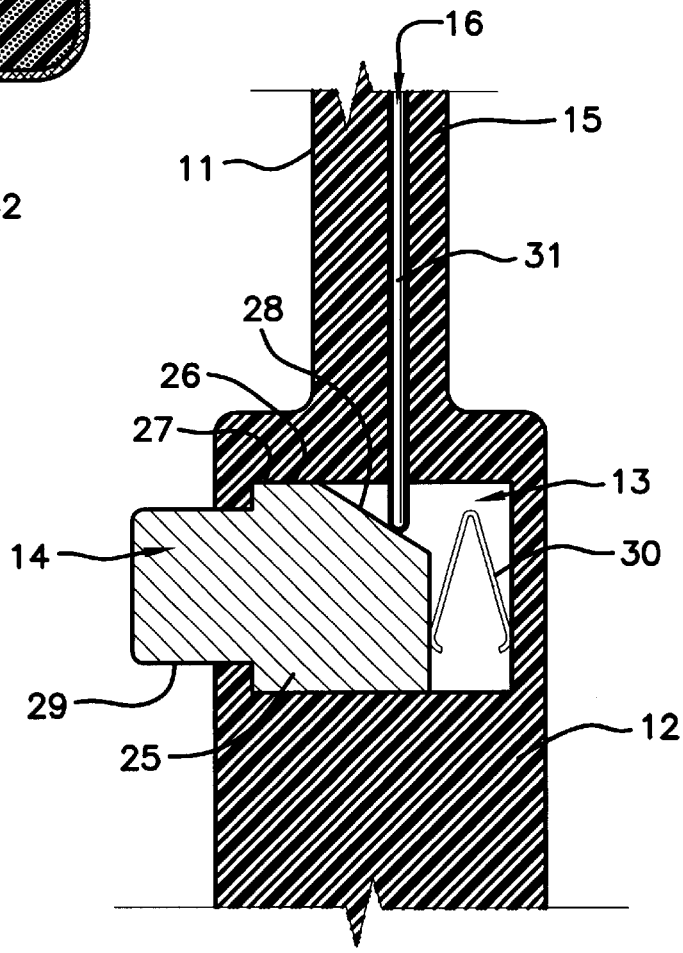
FIG. 4 is a cross-sectional view of the handle portion and the bottom portion of the intermediate portion of the present invention.

With reference now to the drawings, and in particular to FIGS. 1 through 4 thereof, a new hand-held liquid/lotion dispensing device embodying the principles and concepts of the present invention and generally designated by the reference numeral 10 will be described.

As best illustrated in FIGS. 1 through 4, the hand-held liquid/lotion dispensing device 10 generally comprises an elongate member 11 having a handle portion 12, an elongate intermediate portion 15 integrally connected to the handle portion 12, and a dispensing head portion 18 integrally connected to the intermediate portion 15 and having a compartment 22 disposed therein with the compartment 22 being adapted to store liquid/lotion therein. The handle portion 12 has a cavity 13 disposed therein, and the intermediate portion 15 has a bore 16 extending therethrough into the cavity 13 of the handle portion 12 and into the compartment 22 of the dispensing head portion 18. The bore 16 has an enlarged top portion 17 which is disposed through a bottom wall of the compartment 22. The dispensing head portion 18 includes a front wall 19 and a plurality of pores 21 disposed through the front wall 19 into the compartment 22. The dispensing head portion 18 further includes a back wall 20 having an opening 23 disposed therethrough and into the compartment 22 for pouring the liquid/lotion into the compartment 22 with the opening 23 being closeable with a plug member 24 which is threaded into the opening 23. The handle portion 12 includes a hole 14 disposed through a wall thereof and into the cavity 13 with the elongate member 11 having length of approximately 13 inches.

A pump assembly for urging the liquid/lotion from the dispensing head portion 18 includes an actuating member 25,29 movably and biasedly disposed in the cavity 13 of the handle portion 12, and also includes a spring member 30 being disposed in the cavity 13 and being engageable to the actuating member 25,29 for urging a portion of the actuating member 25,29 outwardly through the hole 14, and further includes a stem 31 being movably and biasedly disposed in the bore 16 of the intermediate portion 15 and being engageable to the actuating member 25,29, and also includes a plunger member 32 securely and conventionally attached to a top end of the stem 31 and being movably disposed in the enlarged top portion 17 of the bore 16, and further includes a spring 33 being disposed in the enlarged top portion 17 of the bore 16 and being engageable to the plunger member 32 for urging the plunger member 32 and the stem 31 downwardly. The actuating member 25,29 includes a block-like body member 25 which is movably disposed in the cavity 13, and also includes a boss-like button member 29 securely and integrally attached to the body member 25 and being movably and biasedly disposed through the hole 14 in the handle portion 12 with the block-like body member 25 including a top surface 26 having a first side portion 27 and a second side portion 28 which is slanted downwardly from the first side portion 27. The stem 31 has a bottom end which is in contactable relationship with the second side portion 28 of the block-like body member 25 with the second side portion 28 being adapted to move the stem 31 upwardly in the bore 16.

An applicator assembly is removably attached to the dispensing head portion 18 and includes an applicator member 34 and bracket members 35,38 securely and conventionally attached to edges of the applicator member 34 for securely and removably fastening the applicator assembly about the head portion 18 with the applicator member 34 being disposed upon an exterior of the front wall 19 and over the pores 21. Each of the bracket members 35,38 includes a plate-like member having a first end 36,39 which is securely attached to the applicator member 34, and also having a second end having a flange portion 37,40 extending therefrom with the bracket members 35,38 being essentially parallel to one another with the flange portions 37,40 being directed toward one another. The flange portions 37,40 are adapted to engage about the back wall 20 of the dispensing head portion 18. The applicator member 34 has a length of approximately 4 inches and a width of approximately 2 inches.

In use, the user pours liquid/lotion through the opening 23 in the back wall 20 of the head portion 18 and closes the opening 23 with the plug member 24. The user then presses upon the boss-like button member 29 which urges the stem 31 and plunger member 32 up and down in the bore 16 thus creating pressure in the compartment 22 which forces the liquid/lotion through the pores 21 in the front wall 19 and onto the applicator member 34 which could be a sponge, brush, pumic stone, etc., and the user uses the applicator member 34 to apply the liquid/lotion to one's own body.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A hand-held liquid/lotion dispensing device comprising:

an elongate member having a handle portion, an elongate intermediate portion connected to said handle portion, and a dispensing head portion connected to said intermediate portion and having a compartment disposed therein, said compartment being adapted to store liquid/lotion therein;

a pump assembly for urging the liquid/lotion from said dispensing head portion;

an applicator assembly being removably attached to said dispensing head portion;

wherein said handle portion has a cavity disposed therein, and said intermediate portion has a bore extending therethrough into said cavity of said handle portion and into said compartment of said dispensing head portion;

wherein said bore has an enlarged top portion which is disposed through a bottom wall of said compartment;

wherein said dispensing head portion includes a front wall and a plurality of pores disposed through said front wall into said compartment, said dispensing head portion further including a back wall having an opening disposed therethrough and into said compartment for pouring the liquid/lotion into said compartment, said opening being closeable with a plug member which is threaded into said opening;

wherein said handle portion includes a hole disposed therethrough and into said cavity; and wherein said pump assembly includes an actuating member movably and biasedly disposed in said cavity of said handle portion, and also includes a spring member being disposed in said cavity and being engageable to said actuating member for urging a portion of said actuating member outwardly through said hole, and further includes a stem being movably and biasedly disposed in said bore of said intermediate portion and being engageable to said actuating member, and also includes a plunger member securely attached to a top end of said stem and being movably disposed in said enlarged top portion of said bore, and further includes a spring being disposed in said enlarged top portion of said bore and being engageable to said plunger member for urging said plunger member and said stem downwardly.

2. A hand-held liquid/lotion dispensing device as described in claim 1, wherein said actuating member includes a block-like body member which is movably disposed in said cavity, and also includes a boss-like button member securely attached to said body member and being movably and biasedly disposed through said hole in said handle portion.

3. A hand-held liquid/lotion dispensing device as described in claim 2, wherein said block-like body member includes a top surface having a first side portion and a second side portion which is slanted downwardly from said first side portion.

4. A hand-held liquid/lotion dispensing device as described in claim 3, wherein said stem having a bottom end which is in contactable relationship with said second side portion of said block-like body member, said second side portion being adapted to move said stem upwardly in said bore.

5. A hand-held liquid/lotion dispensing device as described in claim 1, wherein said applicator assembly includes an applicator member and bracket members securely attached to edges of said applicator member for securely and removably fastening said applicator assembly about said head portion with said applicator member being disposed upon an exterior of said front wall and over said pores.

6. A hand-held liquid/lotion dispensing device as described in claim 5, wherein each of said bracket members includes a plate-like member having a first end which is securely attached to said applicator member, and also having a second end having a flange portion extending therefrom, said bracket members being essentially parallel to one another with said flange portions being directed toward one another, said flange portions being adapted to engage about said back wall of said lotion dispensing bead portion.

7. A hand-held liquid/lotion dispensing device comprising:

an elongate member having a handle portion, an elongate intermediate portion connected to said handle portion, and a dispensing head portion connected to said intermediate portion and having a compartment disposed therein, said compartment being adapted to store liquid/lotion therein, said handle portion having a cavity disposed therein, and said intermediate portion has a bore extending therethrough into said cavity of said handle portion and into said compartment of said dispensing head portion, said bore having an enlarged top portion which is disposed through a bottom wall of said compartment, said dispensing head portion including a front wall and a plurality of pores disposed through said front wall into said compartment, said dispensing head portion further including a back wall having an opening disposed therethrough and into said compartment for pouring the liquid/lotion into said compartment, said opening being closeable with a plug member which is threaded into said opening, said handle portion including a hole disposed therethrough and into said cavity, said elongate member having length of approximately 13 inches;

a pump assembly for urging the liquid/lotion from said dispensing head portion including an actuating member movably and biasedly disposed in said cavity of said handle portion, and also including a spring member being disposed in said cavity and being engageable to said actuating member for urging a portion of said actuating member outwardly through said hole, and further including a stem being movably and biasedly disposed in said bore of said intermediate portion and being engageable to said actuating member, and also including a plunger member securely attached to a top end of said stem and being movably disposed in said enlarged top portion of said bore, and further including a spring being disposed in said enlarged top portion of said bore and being engageable to said plunger member for urging said plunger member and said stem downwardly, said actuating member including a block-like body member which is movably disposed in said cavity, and also including a boss-like button member securely attached to said body member and being movably and biasedly disposed through said hole in said handle portion, said block-like body member including a top surface having a first side portion and a second side portion which is slanted downwardly from said first side portion, said stem having a bottom end which is in contactable relationship with said second side portion of said block-like body member, said second side portion being adapted to move said stem upwardly in said bore; and an applicator assembly being removably attached to said dispensing head portion including an applicator member and bracket members securely attached to edges of said applicator member for securely and removably fastening said applicator assembly about said head portion with said applicator member being disposed upon an exterior of said front wall and over said pores, each of said bracket members including a plate-like member having a first end which is securely attached to said applicator member, and also having a second end having a flange portion extending therefrom, said bracket members being essentially parallel to one another with said flange portions being directed toward one another, said flange portions being adapted to engage about said back wall of said lotion dispensing head portion, said applicator member having a length of approximately 4 inches and a width of approximately 2 inches.

8. A hand-held liquid/lotion dispensing device comprising:

an elongate member having a handle portion, an elongate intermediate portion connected to said handle portion, and a dispensing head portion connected to said intermediate portion and having a compartment disposed therein, said compartment being adapted to store liquid/lotion therein;

a pump assembly for urging the liquid/lotion from said dispensing head portion;

an applicator assembly being removably attached to said dispensing head portion;

wherein said handle portion has a cavity disposed therein, and said intermediate portion has a bore extending therethrough into said cavity of said handle portion and into said compartment of said dispensing head portion;

wherein said bore has an enlarged top portion which is disposed through a bottom wall of said compartment;

wherein said dispensing head portion includes a front wall and a plurality of pores disposed through said front wall into said compartment;

wherein said handle portion includes a hole disposed therethrough and into said cavity; and wherein said pump assembly includes an actuating member movably and biasedly disposed in said cavity of said handle portion, and also includes a spring member being disposed in said cavity and being engageable to said actuating member for urging a portion of said actuating member outwardly through said hole, and further includes a stem being movably and biasedly disposed in said bore of said intermediate portion and being engageable to said actuating member, and also includes a plunger member securely attached to a top end of said stem and being movably disposed in said enlarged top portion of said bore, and further includes a spring being disposed in said enlarged top portion of said bore and being engageable to said plunger member for urging said plunger member and said stem downwardly.

9. A hand-held liquid/lotion dispensing device as described in claim 8, wherein said dispensing head portion further including a back wall having an opening disposed therethrough and into said compartment for pouring the liquid/lotion into said compartment, said opening being closeable with a plug member which is threaded into said opening.

10. A hand-held liquid/lotion dispensing device as described in claim 8, wherein said actuating member includes a block-like body member which is movably disposed in said cavity, and also includes a boss-like button member securely attached to said body member and being movably and biasedly disposed through said hole in said handle portion.

11. A hand-held liquid/lotion dispensing device as described in claim 10, wherein said block-like body member includes a top surface having a first side portion and a second side portion which is slanted downwardly from said first side portion.

12. A hand-held liquid/lotion dispensing device as described in claim 11, wherein said stem having a bottom end which is in contactable relationship with said second side portion of said block-like body member, said second side portion being adapted to move said stem upwardly in said bore.

13. A hand-held liquid/lotion dispensing device as described in claim 8, wherein said applicator assembly includes an applicator member and bracket members securely attached to edges of said applicator member for securely and removably fastening said applicator assembly about said head portion with said applicator member being disposed upon an exterior of said front wall and over said pores.

14. A hand-held liquid/lotion dispensing device as described in claim 13, wherein each of said bracket members includes a plate-like member having a first end which is securely attached to said applicator member, and also having a second end having a flange portion extending therefrom, said bracket members being essentially parallel to one another with said flange portions being directed toward one another, said flange portions being adapted to engage about a back wall of said lotion dispensing head portion.

* * * * *